United States Patent [19]

Butts

[11] Patent Number: 5,013,367

[45] Date of Patent: May 7, 1991

[54] RUG CLEANING APPARATUS

[76] Inventor: James N. Butts, 416 Ferncreek Ave. N., Orlando, Fla. 32803

[21] Appl. No.: 467,934

[22] Filed: Jan. 22, 1990

[51] Int. Cl.[5] ..... B08B 1/04; B08B 7/02

[52] U.S. Cl. ..... 134/9; 134/9; 15/40; 15/43; 15/41.1; 15/159 A; 15/77; 15/98; 15/159 R

[58] Field of Search ..... 15/40, 41 R, 43, 159 A, 15/77, 98, 159 R, 88.3; 134/9

[56] References Cited

U.S. PATENT DOCUMENTS

| | | | |
|---|---|---|---|
| 2,971,208 | 2/1961 | Moore et al. | 15/77 |
| 3,482,276 | 12/1969 | Fillery | 15/41 R |
| 3,792,503 | 2/1974 | Brock | 15/77 |
| 4,104,755 | 8/1978 | Smith | 15/40 |

*Primary Examiner*—Theodore Morris

*Assistant Examiner*—Zeinab El-Arini

*Attorney, Agent, or Firm*—James H. Beusse

[57] ABSTRACT

A rug cleaning apparatus comprises a housing having a front wall, a back wall, a top, and a pair of opposite end walls. An opening is formed in the top for allowing insertion of a rug into the apparatus, and a driven roller brush is mounted in the apparatus and extends from one to another of the pair of end walls. The roller brush has bristles extending therefrom for brushing against a rug inserted into the apparatus with at least a portion of the bristles being removed from the roller brush such that during a predetermined portion of rotation of the roller brush a portion of the rug is not in contact with brush bristles. Means attached to the apparatus and positioned adjacent the driven roller urge a rug into contact with the roller brush for brushing debris from the rug and for effecting vibration of the rug by repeated contact and lost of contact between the rug and bristles on the rug.

11 Claims, 2 Drawing Sheets

RUG CLEANING APPARATUS

The present invention relates to portable rug cleaning apparatus and, more particularly, to an apparatus for beating loose particles such as dirt, sand, and hair from throw rugs.

BACKGROUND OF THE INVENTION

Small throw rugs, such as those used in automobiles, are typically cleaned using a vacuum cleaner. Unfortunately, it is well known that such process does not provide for thorough removal of sand, grit, or other debris which accumulates in such rugs. It is a common practice to remove such rugs from an automobile and to repeatedly beat them against a relatively clean surface such as a concrete pad in order to attempt to remove loose sand and grit from the rugs. While such a process may be acceptable for an automobile owner cleaning his/her own rugs on a random basis, it is apparent that such a process is not desirable in a facility such as a car wash which processes many cars during each business day.

SUMMARY OF THE INVENTION

It is an object of the present invention to provide a method and apparatus for cleaning throw rugs which overcomes the above noted disadvantages of the prior art.

It is a more specific object of the invention to provide a power driven apparatus which will rapidly and efficiently remove grit, sand, and other loose debris from throw rugs.

In one form of the present invention, there is provided an apparatus comprising a substantially closed container having a slot at the top for inserting a throw rug or other small rug including a motor driven brush which rapidly brushes the nap on a throw rug inserted through the slot. An auxiliary roller or other similar device is used to press the throw rug against the brush so as to maintain contact between the nap of the rug and the brush. In order to provide a beating action, the brush comprises a relatively large diameter rotating brush in which approximately 25% of the brush bristles have been removed in two equal segments. The two open segments are located on opposite sides of the brush so that as the brush rotates and engages the surface of the rug, the open spaces will periodically release pressure against the rug causing it to flex back towards the brush under pressure from the auxiliary roller. This repeated cycling of the brush surface against the rug surface causes the rug to vibrate so that loose particles are shaken towards the outer surface of the rug. In the preferred embodiment, the brush is in a location vertically lower than the auxiliary roller and the rug is inserted in an inverse position so that the nap faces slightly downward so that gravity will assist in removing the loose particles from the rug. The lower part of the container housing the rollers may be closed by a flexible curtain allowing access to the lower part of the container for cleaning purposes or to retrieve rug that may have been dropped through the rollers. In operation, the rug is inserted from the top and moved up and down across the brush manually, the rotation of the brush being such as to try to pull the rug into the box. The bristles of the brush are selected to be approximately 2½ inches in length so that if a user's fingers happen to engage the rotating roller, no injury will be sustained. The rotating brush may be driven by a standard electric motor connected to the brush by means of a belt and pulley arrangement. Preferably, a pulley on the motor is considerably smaller in diameter than a pulley connected to the roller so that the rotational speed of the brush may be relatively slow, such as, for example, two hundred revolutions per minute.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
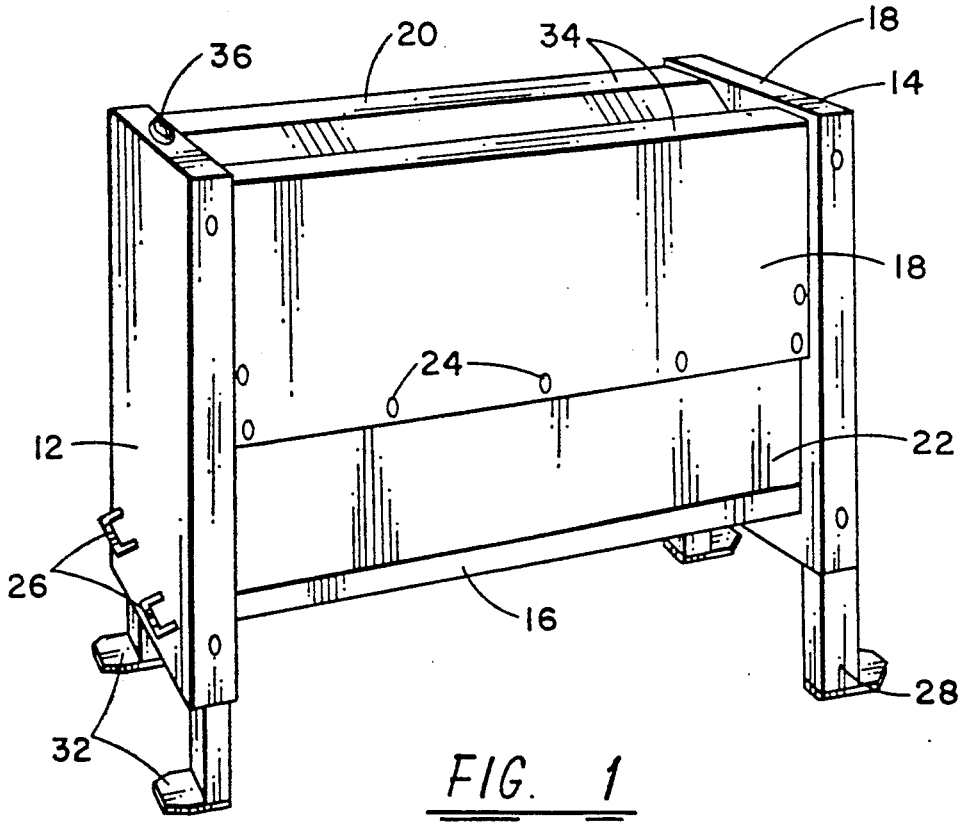
FIG. 1 is a perspective view of an external representation of the present invention.
Figure 3:
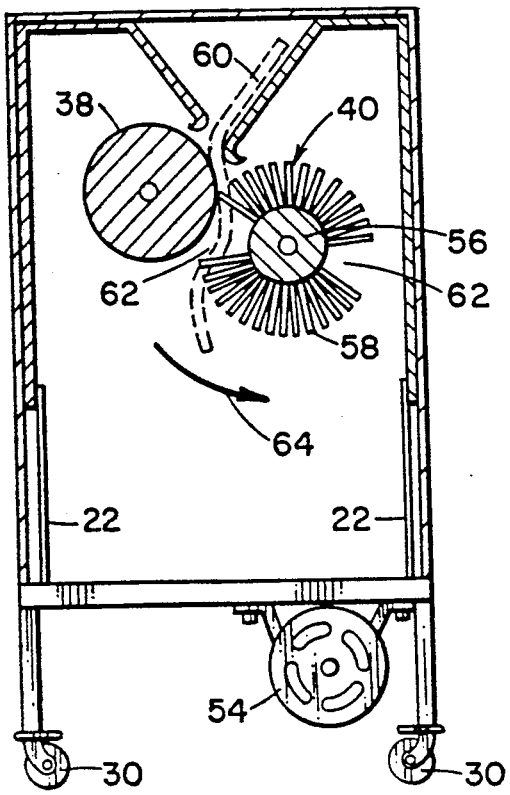
FIG. 3 is a cross-sectional view taken along the line 3—3 in FIG. 2.
Figure 4:
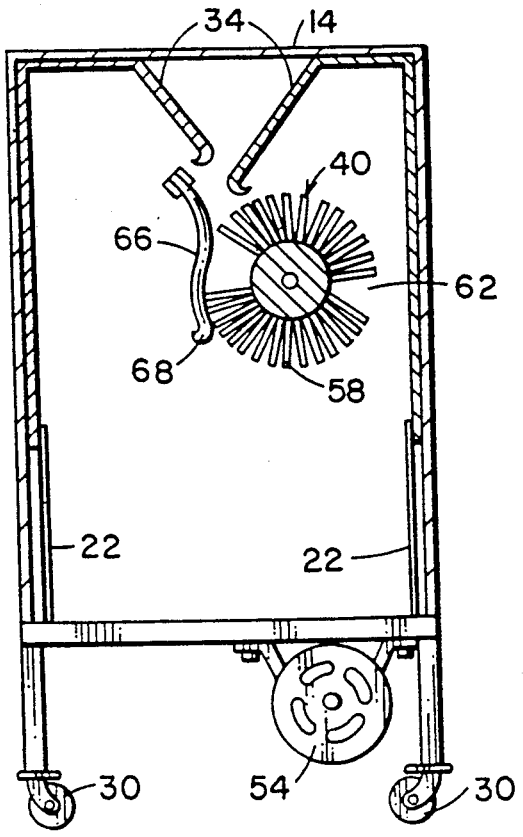
FIG. 4 is a cross-sectional view similar to FIG. 3 showing an alternative arrangement of the auxiliary roller.

Turning now to FIG. 1, there is shown a perspective view of an external appearance of one form of the present invention. The apparatus is embodied within a closed container preferably formed of sheet metal having a left end wall 12 and a right end wall 14. The end walls are connected by means of a lower support panel 16 and front and rear panels 18 and 20. The front wall 18 may extend only partially down the height of the apparatus with a flexible curtain 22 which may be formed of a transparent polyethylene or similar type plastic completing the coverage of the front surface. The use of a clear plastic curtain 22 allows an operator to view the accumulation of dirt and other debris within the housing in preparation for cleaning. The curtain may be attached to the front panel 18 by rivets 24 or other suitable means. The left end panel 12 may include a pair of handles 26 to facilitate movement of the device. Preferably, the right end wall terminates in a pair of legs 28 which may be mounted on wheels 30 such as is shown in FIGS. 3 and 4. The left end wall preferably terminates in a pair of fixed flat feet 32 to assure stability of the rug cleaning apparatus when it is operation.

The top of the apparatus may be formed with separate panels 34 or the panels 34 may be a continuation of the front and rear panels 18 and 20. The two panels 34 are bent downwardly to create a V-shaped slot in the top surface of the apparatus for insertion of a rug. A control switch 36 is mounted on the top of the left end panel 12 for coupling power to the motor energizing apparatus.

Figure 2:
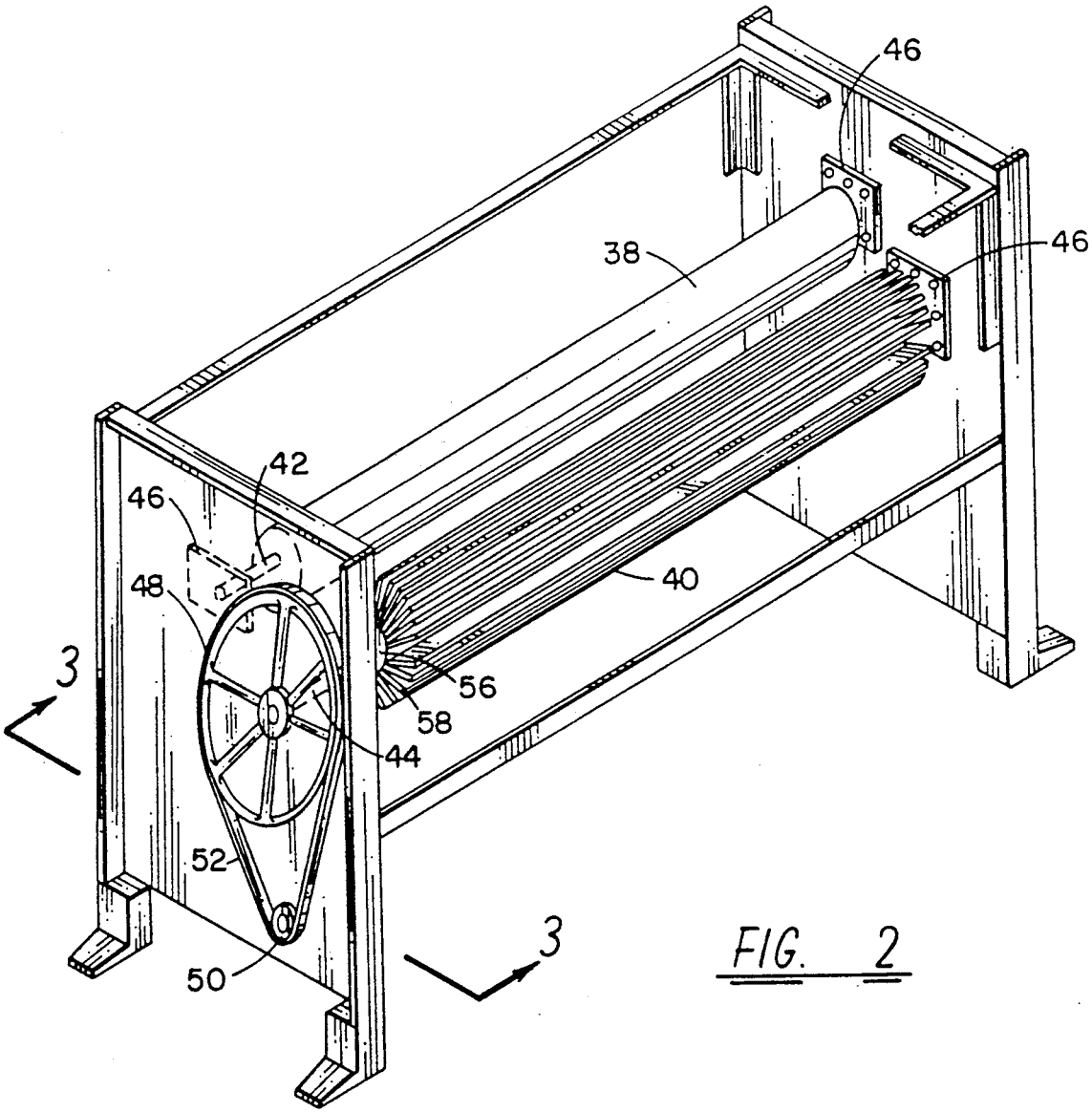
FIG. 2 is a perspective view similar to that of FIG. 1 but with the external covers removed.

Turning now to FIG. 2, there is shown a view similar to that of FIG. 1 but with the outside covers of the apparatus removed. Positioned within the apparatus 10, in one form, is a pair of rollers 38 and 40. Each of the rollers 38 and 40 have respective axles 42 and 44 which extend through the rollers and continue a predetermined distance on each end thereof. At each end 12 and 14 of the apparatus, the axles are mounted in flanged bearing assemblies 46. The flanged bearing assemblies 46 may be riveted or bolted to respective ends of the cleaning apparatus. At the left hand end 12 of the apparatus 10, the axle 44 for the large brush carrying roller 40 extends through the end wall 12 and connects to a large pulley 48. A small pulley 50 is located below the large pulley 48 and a V-belt 52 extends over the small pulley and around the large pulley. A motor 54, best seen in FIGS. 3 and 4, is connected to the small pulley 50 and drives it at a relatively fixed speed such as, for example, 1750 RPM. The sizing of the small pulley 50 and large pulley 48 is selected so as to provide an approximately six-to-one speed reduction so that the driven roller 40 rotates at approximately 200–250 RPM. The roller 38 is an auxiliary or idler roller and is provided merely to compress a rug inserted into the apparatus against the brush carrying roller 40. The roller 38 may be a steel roller or formed of other relatively hard material. The roller 40, which may in the order of eight inches in diameter, has a central three inch metal portion 56 to which is attached a plurality of relatively stiff fibers or bristles 58.

Turning now to FIG. 3, there is shown a cross-sectional view taken along line 3—3 of FIG. 2 which better illustrates the brush and idler assembly 38 and 40. As can be seen, the brush roller 40 has a center portion 56 to which are attached a plurality of external brush bristles 58. The brush bristles 58 extend around the majority of the circumference of the center portion but there are provided at least two gaps in the brush fibers so that the brush will establish a beating rhythm with respect to a carpet 60 inserted into the V-shaped top portion of the apparatus. As the carpet 60 is brushed by the brushes 58, an open section 62 causes the carpet to flex more towards the roller 40 and induces a vibration into the carpet area. This vibration tends to cause the loose debris collected in the carpet to vibrate towards the surface where the rapidly rotating brushes 58 brush the debris away from the carpet. The roller 40 rotates in the direction indicated by the arrow 64 also trying to pull the debris downward towards the bottom of the apparatus.

An operator holding onto an upper end of the carpet 60 may process the carpet through the cleaning operation by allowing a carpet to fall almost to the end of the V-shaped portion at the top of the apparatus and then pulling the carpet back upward against the rotation of the brushes. Repetition of this action has been found effective in providing excellent cleaning of carpets. While the rotating brush without the gap 62 provides some cleaning of the carpet, it has been found that the vibration induced by removing a small portion of the brushes significantly increases the cleaning capability of the apparatus. The sole function of the idler roller 38 is to pressure the carpet towards the cleaning brushes 58 on roller 40. Accordingly, the idler roller 38 may be mounted in bearings 46 as was described with regard to FIG. 2 or the roller itself may be fixed and not rotatable. Referring to FIG. 4, there is shown an alternate embodiment of the invention in which the roller 38 has been replaced by a sheet metal guide 66 attached to the ends 12 and 14 of the apparatus in a position so as to merely force a carpet inserted through the top of the apparatus into contact with the rotating roller 40. Guide 66 may be pivotably mounted to the ends 12, 14 allowing the guide to swing or pivot and vary the displacement between the guide surface and the adjacent driven brush roller 40 for accommodating different thicknesses of rugs. A spring, not shown, may be used to push or pull the guide toward the roller 40. The sheet metal guide 66 includes an upturned end 68 to prevent snagging of a carpet inserted in the apparatus. It will also be noted that the ends of the top panels 34 of the apparatus are also reversely deformed so as to avoid snagging of any carpet inserted in the apparatus.

While the use of a roller 40 in which two sections of brushes 58 have been removed constitutes a preferred form of the invention, it is possible that adequate cleaning may be provided by a roller 40 in which more or less sections of brushes 58 have been removed. Furthermore, the amount of space in which the brushes 58 have been removed may be varied slightly although in the preferred embodiment, the total amount of removed brush surface amounts to about 25% of the roller 56 circumference, or about 12½% on each side of the roller. In either case, the invention is effective to "dry" clean the rugs and does not require use of any liquid (although spot cleaner may be applied to discolorations).

While the invention has been described in what is presently considered to be a preferred embodiment, other modifications, variations, and improvements will become apparent to those of ordinary skill in the art. It is intended therefore that the invention not be limited to the described embodiment but be interpreted within the full spirit and scope of appended claims.

What is claimed is:

1. A dry rug cleaning apparatus for carpet type rugs comprising a housing having a front wall, a back wall, a top, and a pair of opposite end walls, an opening being formed in the top for allowing insertion of a rug into the apparatus, a driven roller brush being mounted in the apparatus and extending from one to another of the pair of end walls, the roller brush having bristles extending therefrom for brushing against a nap surface of a rug inserted into the apparatus, at least a portion of the bristles being removed from the roller brush such that during at least a predetermined portion of rotation of the roller brush a portion of the rug nap surface is not in contact with brush bristles, and means attached to the apparatus and positioned adjacent the driven roller for urging the rug nap surface into contact with the roller brush for brushing debris from the rug and for effecting vibration of the rug by repeated contact and lost of contact between the rug nap surface and bristles on the rug.

2. The rug cleaning apparatus of claim 1 and including an electric motor mounted to the apparatus and connected in driving relationship with the driven roller for effecting rotation thereof.

3. The rug cleaning apparatus of claim 2 wherein said roller brush includes a central axle and said apparatus further includes a first pulley connected to said axle, a second pulley connected to a shaft of said motor and a V-belt coupled between said first and second pulleys for driving said roller brush from said motor.

4. The rug cleaning apparatus of claim 1 wherein said means for urging a rug into contact with said roller brush comprises a second non-driven roller.

5. The rug cleaning apparatus of claim 1 wherein said means for urging a rug into contact with said roller brush comprises a sheet metal segment having a contact surface circumscribing a portion of the circumference of said driven roller brush.

6. The rug cleaning apparatus of claim 1 wherein said bristles are removed from about 25% of the circumference of said roller brush.

7. The rug cleaning apparatus of claim wherein the bristles are removed from two portions of the circumference of said roller brush each located opposite one another about the roller brush circumference.

8. The rug cleaning apparatus of claim 3 wherein said first pulley has a diameter of about five times the diameter of said second pulley whereby said roller brush is driven at a rotational speed less that the rotational speed of said motor shaft.

9. The rug cleaning apparatus of claim 4 wherein said non-driven roller is positioned vertical higher than said roller brush and arranged such that a lower surface of a rug contacting said roller brush is angled downward.

10. The rug cleaning apparatus of claim 9 wherein said roller brush is driven in a direction tending to pull a rug downward.

11. A method for dry cleaning loose and embedded debris from the nap of a throw rug or similar carpet surface article using a power driven rug cleaning apparatus having a rotating roller brush and guide means for urging the rug into contact with the brush, the roller brush having at least a portion thereof in which bristles have been removed and the urging means being positioned so as to urge the nap of the rug into the remaining bristles such that the rug is angled in a downward direction to allow gravity to cause loose debris to fall away from the rug, the method comprising the steps of:

turning the rug into a substantially inverted orientation so that the nap of the rug is oriented downwardly;

applying power to the apparatus to effect rotation of the roller brush;

inserting the rug into the apparatus in its inverted orientation such that the nap of the rug contacts the rotating brush;

inserting and withdrawing the rug into and out of the apparatus such that the bristles of the roller brush repeatedly brush the nap of the rug and the rug is caused to vibrate by the effect of the missing bristles changing the contact surface on the roller brush; and repeating the step of inserting and withdrawing until the rug is satisfactorily clean.

* * * * *